United States Patent [19]

Uggetti

[11] Patent Number: 5,018,885

[45] Date of Patent: May 28, 1991

[54] CASSETTE FOR A PRINTING RIBBON FOR TYPEWRITERS

[75] Inventor: Sergio Uggetti, Ivrea, Italy

[73] Assignee: Ing. C. Olivetti & C., S.p.A., Ivrea, Italy

[21] Appl. No.: 517,845

[22] Filed: May 2, 1990

[30] Foreign Application Priority Data

May 18, 1989 [IT] Italy ..... 67363 A/89

[51] Int. Cl.[5] ..... B41J 32/00

[52] U.S. Cl. ..... 400/196; 400/207; 206/53; 206/389; 206/206; 242/129.7

[58] Field of Search ..... 400/207, 208, 208.1, 400/196, 196.1, 194; 53/138 R, 329; 206/389, 53, 206; 242/149, 129.7, 129.71, 74.1

[56] References Cited

U.S. PATENT DOCUMENTS

| | | | |
|---|---|---|---|
| 3,381,810 | 5/1968 | Lasher | 400/207 |
| 3,941,231 | 3/1976 | Coleman et al. | 400/196.1 |
| 4,368,992 | 1/1983 | Gagnebin | 400/196 |
| 4,627,118 | 12/1971 | Daggs | 400/207 |

FOREIGN PATENT DOCUMENTS

| | | | |
|---|---|---|---|
| 2557803 | 12/1977 | Fed. Rep. of Germany | 400/196 |

OTHER PUBLICATIONS

"Cartridge Shipping Tab", IBM Tech. Disclosure Bulletin, vol. 20, No. 1, Jun. 1977, p. 42.

*Primary Examiner*—Eugene H. Eickholt
*Attorney, Agent, or Firm*—Banner, Birch, McKie & Beckett

[57] ABSTRACT

A cassette for a printing ribbon comprises a casing accommodating a supply spool which has a tube on which the printing ribbon is wound. An anti-unrolling element of plastics material comprises two portions of elongate shape, which are connected by means of an integral elastic hinge. The first portion performs a guiding and positioning function and is accommodated by means of a slot within the casing. The second portion has a blocking function with regard to the tube, and is movable on the outside of the casing, by means of the elastic hinge, from an inoperative position in which it is aligned with the first portion to an operative position in which it is rotated through 180° and is substantially in superposed relationship with the first portion. The second portion is provided with a hook element which, in its operative position, engages the tube through an opening in the casing for positively blocking the supply spool both during storage and during transportation of the cassette to inhibit unrolling in a simple and reliable manner.

20 Claims, 2 Drawing Sheets

CASSETTE FOR A PRINTING RIBBON FOR TYPEWRITERS

BACKGROUND OF THE INVENTION

The present invention relates to a cassette for a printing ribbon for typewriters comprising a casing, a supply spool which is accommodated in the casing and has a tube on to which the printing ribbon is wound, and an anti-unrolling element to prevent unrolling movements of the ribbon when the cassette is not mounted on the machine, having a portion which can be inserted into a slot in the casing.

German utility model No. 68 03 26 07.4 discloses a cassette of that type which has an anti-unrolling element in the form of a holding blade portion having a central groove. The blade portion is inserted into a seat in the casing and, by means of the central groove, is engaged and guided on a sleeve on which the tube of the supply spool is rotatable. The blade portion is inserted between the lower part of the cover and the upper edge of the ribbon until it is stopped with the bottom of the groove against the sleeve. The length of the blade portion is such that it engages all the turns of the ribbon which is wound on the supply spool, thus compressing the spool against the bottom of the casing. The blade portion prevents undesirable unrolling movements of the ribbon but it suffers from disadvantages. In particular, the blade portion engages the upper edge of the ribbon with the rather limited width of the blade portion, during insertion thereof, while it remains in the casing and during withdrawal thereof, whereby it causes substantial squashing with deformation of the upper edge of the ribbon.

SUMMARY OF THE INVENTION

The object of the present invention is therefore to provide a cassette with an anti-unrolling element which is simple, reliable, functional, and of low cost and in which the anti-unrolling element no longer comes into contact with the ribbon which is wound on the supply spool.

That object is met by the cassette for a printing ribbon according to the invention, in which the anti-unrolling element comprises a second portion connected to the first portion by a hinge element, in which that second portion is movable on the outside of the casing by means of the hinge element from an inoperative position to an operative position, and in which the second portion comprises a hook element which can be inserted by way of an opening in the casing to engage the tube and positively block the supply spool when the second portion is in the operative position.

BRIEF DESCRIPTION OF THE DRAWINGS

A preferred embodiment of the invention is set forth in the following description which is given by way of non-limiting example and with reference to the accompanying drawings in which.

DESCRIPTION OF THE PREFERRED EMBODIMENT

Figure 1:
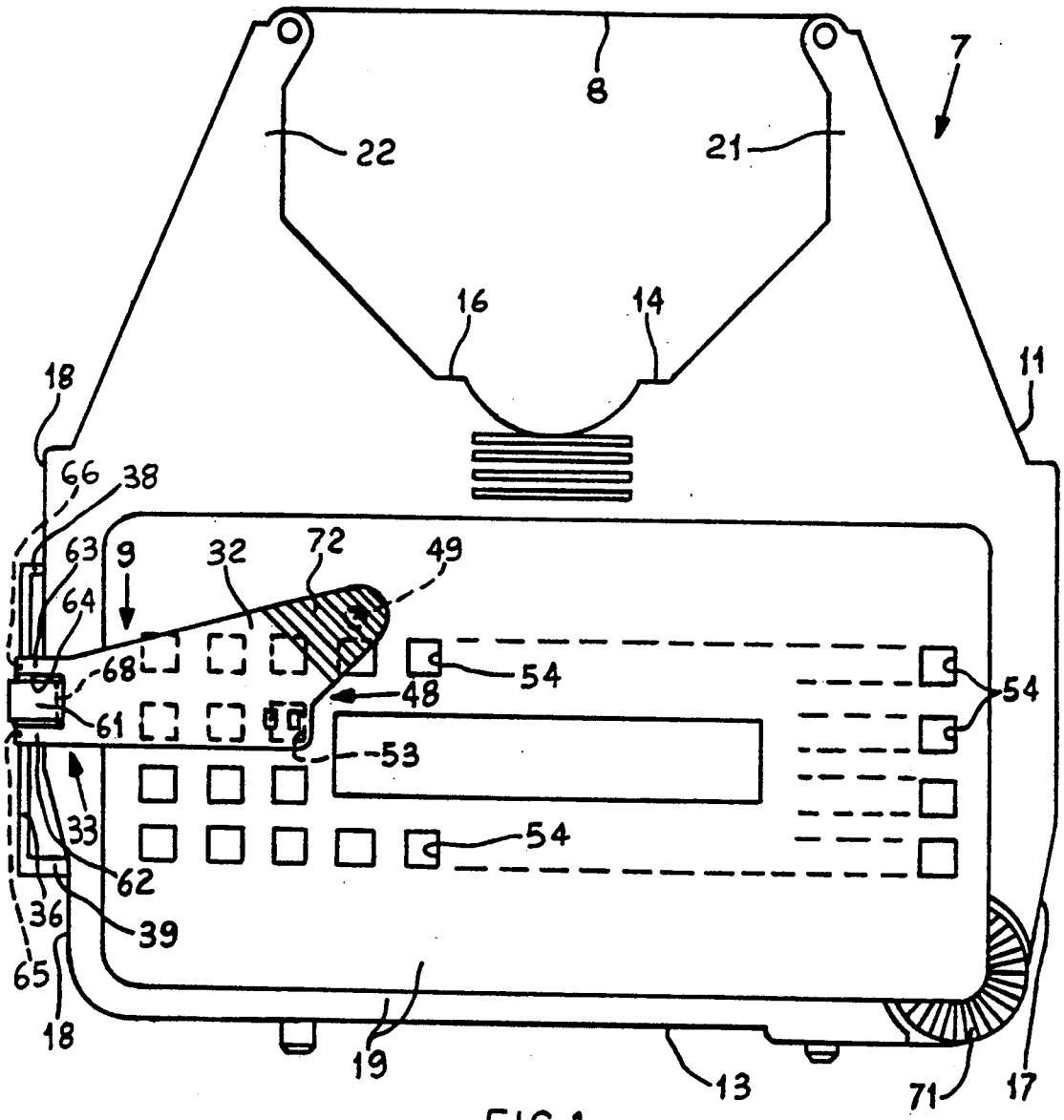
FIG. 1 is a plan view of part of a cassette with an anti-unrolling element according to the invention.
Figure 2:
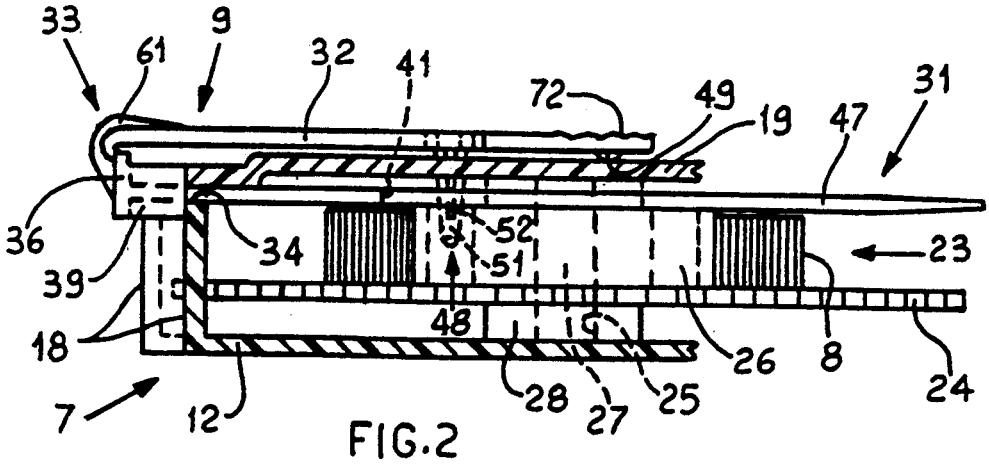
FIG. 2 is a view in section of part of the cassette shown in FIG. 1 on an enlarged scale.
Figure 3:
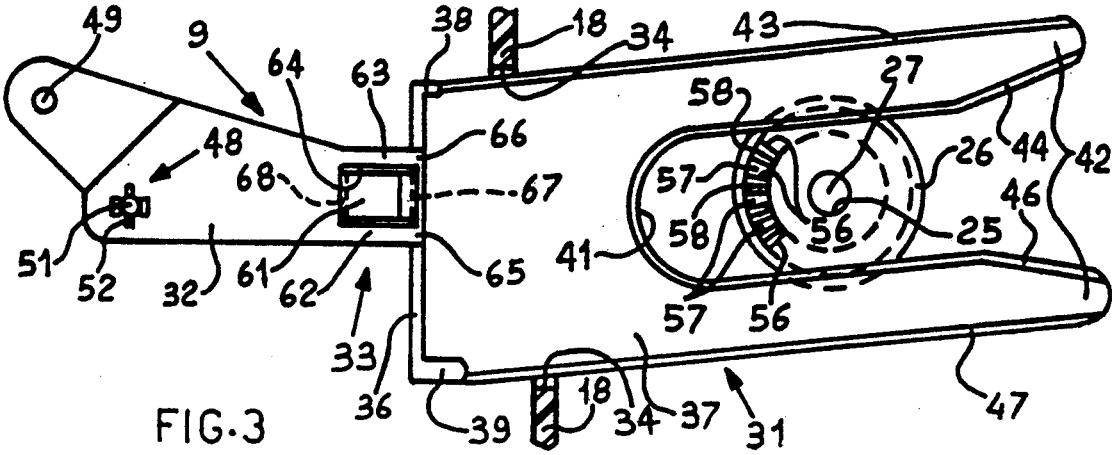
FIG. 3 is a partial plan view of some details from FIG. 1 in an inoperative position.
Figure 4:
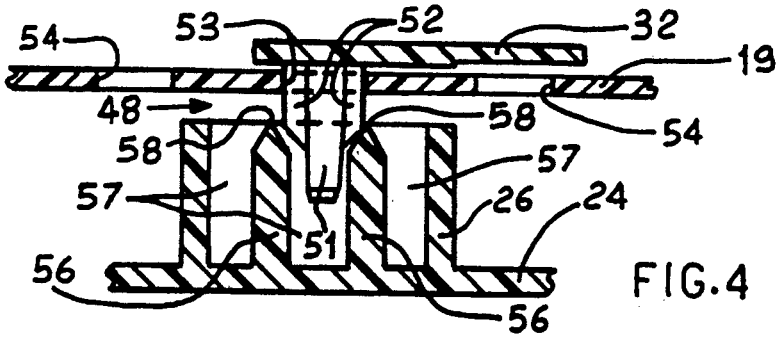
FIG. 4 is a partial view in section of some details from FIG. 1 on an enlarged scale.
Figure 5:
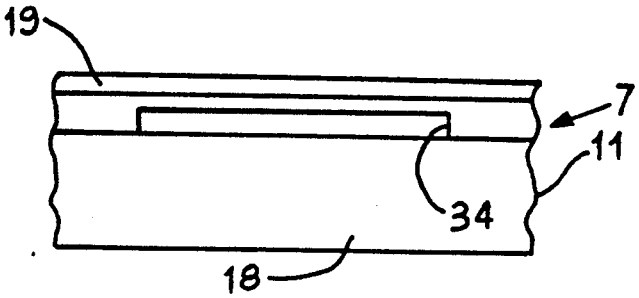
FIG. 5 is a side view of part of the cassette shown in FIG. 1.
Figure 6:
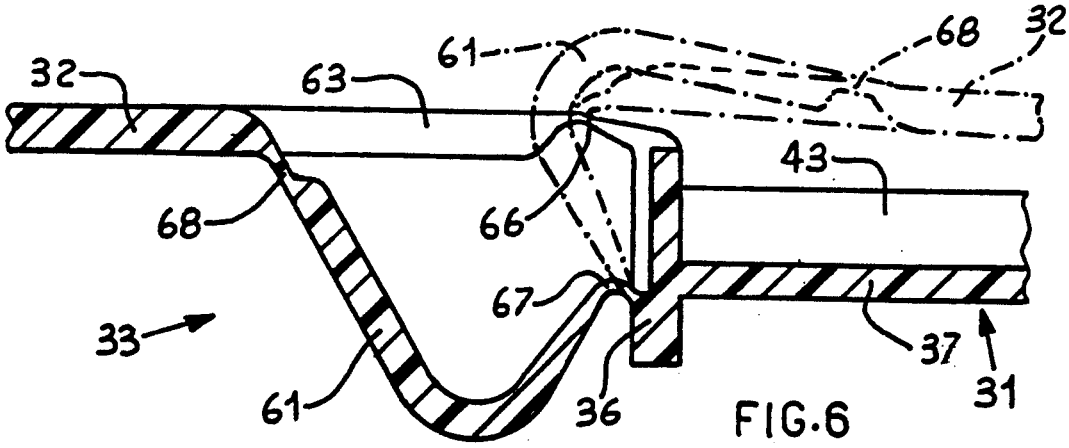
FIG. 6 is a view in section on an enlarged scale of some parts of the anti-unrolling element shown in FIG. 1.

Referring to FIGS. 1 and 2, reference numeral 7 generally indicates a cassette for a printing ribbon 8, on which an anti-unrolling element 9 is mounted.

The cassette 7 is substantially similar to the cassette shown in United Kingdom Design No. 1,053,016 and described in European Patent Application No. 0,333,375. The cassette 7 is therefore only partially described and illustrated in order not to complicate the present description.

The cassette 7 comprises a casing 11 having a bottom 12, a front wall 13, two rear walls 14 and 16, a right-hand side wall 17, a left-hand side wall 18 and a cover 19 which upwardly closes the casing 11. The cassette 7 has two arms 21 and 22 projecting from the rear walls 14 and 16 respectively.

Accommodated in the casing 11 is a supply spool which is generally indicated by reference numeral 23 and on which the printing ribbon 8 is wound. The supply spool 23 comprises a tube 26 which is fixed and integral in the lower portion with a flange 24 and rotatable with an internal wall 25 on a pin 27 projecting from the bottom 12. The tube 26 comprises a hub 28 projecting downwardly from the flange 24 and normally bearing against the bottom 12, and it is of greater height than the height of the ribbon 8 which is wound on the tube 26.

The anti-unrolling element 9 (see FIGS. 1, 2, 3, 4 and 6) comprises a first portion 31 and a second portion 32, both of elongate shape and connected together by an elastic hinge element 33. The first portion 31 has a guiding and positioning function, being accommodated within the casing 11 by means of a slot 34 in the left-hand side wall 18. The first portion 31 comprises a horizontal blade portion 37 and a vertical wall 36 which is substantially perpendicular to the blade portion 37 and which carries the hinge element 33 at its top. Two positioning edges 38 and 39 are located respectively at the two ends of the vertical wall 36. The edges 38 and 39 co-operate with the left-hand side wall 18 of the casing 11, adjacent to the ends of the slot 34, to define a stable position for the first portion 31 when it is accommodated in the slot 34. The horizontal blade portion 37 comprises a central slot 41 which is open at the end opposite to the vertical wall 36 and which defines a fork 42. Ribs 43, 44, 46 and 47 are fixed with respect to the side edges of the horizontal blade portion 37 and the fork 42, with a stiffening function.

The second portion 32 of the element 9 performs a blocking function, being movable on the outside of the casing 11 by means of the elastic hinge element 33 from an inoperative position in which it is aligned with the first portion 31 to an operative position in which it is rotated through 180° and is parallel to and in superposed relationship with the first portion 31. The second portion 32 is formed by a flat blade portion having a hook element 48 and a stop element 49 which both project in the same direction. The hook element 48 is positioned in the casing 11 to engage the tube 26 and to prevent unrolling movement of the supply spool 23. The stop element 49 is of a hemispherical shape capable of co-operating with the external surface of the cover 19 to hold the blade portion 32 slightly spaced from the external surface of the cover 19.

The hook element 48 comprises a pin 51 having the free end chamfered or rounded off and two lateral ribs 52 which are fixed with respect to the pin 51 but which are positioned at diametrically opposite sides. Each lateral rib 52 has its free end in the form of an inclined surface which is directed towards the pin 51 in such a way as to facilitate engagement with the edges of an opening 53 in the cover 19. The opening 53 is one of a series of openings 54 of substantially square shape provided in the cover 19, to perform the function of reducing weight and preventing rumbling noise or resonance. The hook element 48 is positioned and guided in the opening 53 for subsequently coming into engagement with the tube 26 when the second portion 32 is in the operative position, as will be described in greater detail hereinafter. Finally the two lateral ribs 52 are of the same length but are of a length which is substantially less than the length of the pin 51.

The tube 26 comprises a series of radial spokes 56 for connection to the internal wall 25, the spokes 56 defining internal spaces 57 and having their upper edges each formed by two inclined sides and terminating with a pointed edge 58 in order to prevent any jamming as between the chamfered or rounded-off end of the pin 51 and the edge 58 of the radial spoke 56 and thus to facilitate the movement of the pin 51 into and the positioning thereof in one of the spaces 57, as described in greater detail hereinafter.

The anti-unrolling element 9 is made in one piece (from plastics material, preferably polypropylene). The elastic hinge element 33 comprises two bar portions 62 and 63 of the second portion 32, which define a space 64 and which are connected to the top of the vertical wall 36 of the first portion 31 by means of two flexible sections 65 and 66. The elastic hinge element 33 further comprises a bistable spring 61 of known type which is capable of stably holding the second portion 32 both in the inoperative position and in the operative position. In particular the bistable spring 61 comprises an L-shaped body between the two bar portions 62 and 63 and connected by means of two flexible sections 67 and 68 to the base of the wall 36 and to the bottom of the space 64. The bistable spring 61 and the bar portions 62 and 63 are of different thicknesses over their length, the sections 65 and 66, 67 and 68 having to bend to move the second portion 32 from the inoperative position in which it is beside the first portion 31 to the operative position in which it is rotated through 180° and is parallel and in superposed relationship with the first portion 31. In particular both the bar portions 62 and 63 and the bistable spring 61 are of greatly reduced thicknesses at the sections 65, 66, 67 and 68. The sections 65, 66, 67 and 68 suitably behave as a hinge, being very thin and flexible.

The procedure for mounting the anti-unrolling element 9 in place is as follows:

The anti-unrolling element 9 is disposed with the fork 42 at the location of the slot 34 and it is inserted into the casing 11 while the second portion 32 is in its inoperative position. After a certain insertion movement, the lower portions of the fork 42 bear against the free end of the tube 26 and thus the first portion 31 is supported by the edges of the slot 34 and the free end of the tube 26. The first portion 31 is inserted until the positioning elements 38 and 39 engage with the left-hand side wall 18 of the casing 11 and define a very precise position for the first portion 31 without interfering either with the pin 27 or with other internal parts of the container 11 or, in a particular manner, with the upper edge of the ribbon 8.

The second portion 32 is now rotated in a clockwise direction through 180° by means of the sections 65 and 66 and against the action of the bistable spring 61 to move it from the inoperative position to the operative position. The bistable spring 61 also rotates and firstly applies an opposite force to that applied to the portion 32 until, when it has moved beyond its dead centre position, it assists with such rotary movement. The hook element 48 is positioned and guided with the lateral ribs 52 bearing against the edges of the opening 53. By a pressure being applied to the portion 32, the element 48 is definitively positioned in one of the internal spaces 57 in the tube 26. The bistable spring 61 then holds the second portion 32 in the operative position which it has thus reached and in which it is disposed parallel to and in superposed relationship with the first portion 31 with the stop element 49 bearing against the external surface of the cover 19.

The ribbon 8 is now no longer exposed to any risk of unwinding or becoming slack. Indeed, on rewinding handle member 71 the cassette has a reverse means which is known and described in European Patent Application No. 0,333,375 which prevents any slackening movements of the ribbon 8 in the opposite direction to the normal feed movement thereof. The pin 51 with the lateral ribs 52 is now positioned and accommodated both in the opening 53 and in one of the internal spaces 57 whereby, following an attempt to rotate the handle member 71, the tube 26 can perform only a very slight rotary movement since it is immediately stopped by one of the radial spokes 56 bearing against the pin 51.

To remove the anti-unrolling element 9 from the cassette 7, operation is as follows:

The second portion 32 is slightly spaced from the cover 19 by virtue of the stop element 49 and also comprises a toothed or knurled zone 72 which is disposed at the location of the stop element 49 but which is positioned on the opposite side, to facilitate engaging the second portion 32 when it is to be rotated through 180° in the anti-clockwise direction.

After a slight rotary movement, the hook element 48 comes out of the internal space 57 and the opening 53, thus freeing the tube 26. The bistable spring 61 firstly exerts an opposite force until, when it has moved beyond its dead centre position, it assists with such rotary movement to position the second portion 32 in its inoperative position in which it is rotated through 180° with respect to the operative position and is disposed beside the first portion 31.

The first portion 31 is then withdrawn until it comes completely out of the slot 34 and the cassette 7 is ready to be mounted on the machine.

It will be apparent that the first portion 31, the second portion 32 and the elastic hinge element 33 are joined together and are formed in one piece comprising all the other parts such as the hook element 48, the stop element 49, two positioning elements 38 and 39 and the various ribs 43, 44, 46 and 47. In addition the central groove 41 is of a predetermined length and width such as not to interfere with the internal parts of the casing 11 while permitting the hook element 48, when the second portion 32 is in the operative position, to pass through the same in order to come into engagement with the internal spaces 57 in the tube 26. Finally the anti-unrolling element 9 is of a very different and distinctive colour from that of the cassette 7 such that the cassette 7 cannot be fitted to the machine without the operator noticing it. The operator can then proceed to fit the cassette after having opened the portion 32 and withdrawn the anti-unrolling element 9 from the casing 11.

It will be appreciated that the cassette 7 for a ribbon 8 and the anti-unrolling element 9 may be the subject of modifications and improvements both in regard to the shape and the arrangement of the various elements and components without departing from the scope of the present invention.

What I claim is:

1. A cassette for a printing ribbon for typewriters, comprising:

a casing, having a slot and an opening;

a supply spool accommodated in said casing and having a tube on to which a printing ribbon is wound;

an anti-unrolling element to prevent unrolling movements of said ribbon when said cassette is not fitted to a typewriter and having a first portion which can be inserted into said slot in said casing and a second portion;

said anti-unrolling element comprising a hinge element connecting said second portion to said first portion;

said second portion being movable on the outside of said casing by means of said hinge element from an inoperative position to an operative position; and said second portion comprising a hook element which can be inserted through said opening in said casing to engage said tube and positively block said supply spool when said second portion is in said operative position.

2. A cassette according to claim 1, wherein said first portion has a guiding and positioning function and is accommodated by way of said slot within said casing, and said second portion has a blocking function and is movable on the outside of said casing from the inoperative position in which it is aligned with said first portion to the operative position in which it is rotated through 180° and is parallel to and in superposed relationship with said first portion and in which said hook element is engaged with said tube.

3. A cassette according to claim 2, wherein said first portion comprises two positioning elements capable of co-operating with external portions of said casing adjacent to said slot for positioning said first portion in a reference position, when said first portion is inserted into said casing by way of said slot.

4. A cassette according to claim 2, wherein said second portion comprises said hook element and a stop element which is capable of co-operating with the external surface of said casing to hold said second portion slightly spaced from said external surface such as to facilitate engaging said second portion to move it from the operative position to the inoperative position.

5. A cassette according to claim 1, wherein said hook element comprises a pin having a free end chamfered or rounded-off and two lateral ribs which are fixed with respect to said pin but positioned at diametrically opposite sides and each having their free end in the form of an inclined surface which is directed towards said pin such as to facilitate engagement with the edges of said opening, and wherein said two lateral ribs are of the same length but their length is substantially less than the length of the said pin.

6. A cassette according to claim 5, wherein said opening is formed by a series of openings provided in the external surface of a cover of the casing and that said hook element is positioned and guided in said opening for subsequently engaging said tube when said second portion is in said operative position.

7. A cassette according to claim 6, wherein said tube has a series of radial spokes which delimit a series of internal spaces in which the upper edges of said series of spokes are formed by two inclined walls which terminate with an edge in such a way as to prevent jamming as between the rounded-off or chamfered end of said pin and the upper edge of the radial spoke to assist with movement of said pin into one of said internal spaces and positioning of said pin therein during positioning of said second portion from the inoperative position to the operative position.

8. A cassette according to claim 3, wherein said first portion comprises an elongate blade portion and a wall substantially perpendicular to said elongate blade portion and wherein said two positioning elements are disposed at the lateral ends of said wall and are capable of co-operating with the side wall of the casing adjacent to the ends of said slot to determine the position of said first portion in said casing and wherein said horizontal blade portion comprises a central groove which is open at the end opposite to said wall in order to define a fork and wherein said elongate blade portion and said fork are stiffened by integral ribs provided on the respective side edges.

9. A cassette according to claim 8, wherein said first portion is guided and supported by said slot in said casing and by the upper edge of said tube, and that said tube is of greater height than the height of the ribbon which is wound on said tube.

10. A cassette according to claim 8, wherein said central groove is of a predetermined length and width such as not to interfere with internal portions of the casing and to permit said hook element to pass to engage said tube when said second portion is in the operative position.

11. A cassette according to claim 1, wherein said first portion, said second portion and said hinge element are joined together and are formed by a single piece of plastics material and wherein said hinge element comprises flexible portions of limited thickness.

12. A cassette according to claim 1, wherein said hinge element is positioned between said first portion and said second portion and comprises a bistable spring capable of holding said second portion stably both in the inoperative position and in the operative position.

13. A cassette according to claim 12, wherein said hinge element comprises said bistable spring and two hinge bar portions positioned at the sides of said bistable spring.

14. A cassette according to claim 13, wherein said first portion, said second portion and said hinge element are joined together and are formed by a single piece of plastics material and wherein said hinge element comprises flexible portions of limited thickness.

15. A cassette according to claim 14, wherein said first portion is provided with a main part and a projecting part, wherein said hinge bar portions are connected to a tip of said projecting part by means of two first flexible sections of limited thickness and wherein said bistable spring comprises an L-shaped body connected to said second portion and to a base of said projecting part by means of two other flexible portions of limited thickness for stably positioning said second portion from the operative position in which it is aligned with said first portion to the operative position in which it is rotated through 180° and is parallel to and in superposed relationship with said first portion and vice-versa.

16. A cassette according to claim 1, wherein said anti-unrolling element is of plastics material and is of a colour which is completely different from and not to be confused with the colour of said cassette.

17. A cassette for a printing ribbon for typewriters, comprising:

a casing, having a slot and an opening;

a supply spool accommodated in said casing and having a tube on to which a printing ribbon is wound;

anti-unrolling means to prevent unrolling of said ribbon when said cassette is not fitted to a typewriter and having a first portion inserted into said slot in said casing and a second portion;

said first portion having a central groove open at an inner end of said first portion and defining a fork, said fork engaging opposed sides of said tube to guide and position said first portion;

said second portion being movable on the outside of said casing from an inoperative position to an operative position and comprising blocking means inserted through said opening in said casing to engage said tube and positively block said supply spool against rotation when said second portion is in said operative position.

18. A cassette according to claim 17, wherein said first portion has two positioning elements capable of co-operating with external portions of said casing adjacent said slot for positioning said first portion in a reference position when said first portion is inserted into said casing by way of said slot.

19. A cassette for a printing ribbon for typewriters, comprising:

a casing, having a plurality of openings;

a supply spool accommodated in said casing and having a central member on to which a printing ribbon is wound;

a one-piece anti-unrolling element to prevent unrolling of said ribbon when said cassette is not fitted to a typewriter and having a first portion which can be inserted into a first one of said openings in said casing and a second portion, said anti-unrolling element further comprising an integral hinge connecting said second and first portions;

said second portion being movable on the outside of said casing by means of said hinge from an inoperative position to an operative position, and comprising blocking means which can be inserted through a second one of said openings in said casing to engage said supply spool and positively block said supply spool against rotation when said second portion is in said operative position.

20. A cassette according to claim 19, wherein said hinge comprises a bistable spring capable of holding said second position stably both in said inoperative position and in said operative position.

* * * * *